United States Patent [19]

Mason

[11] Patent Number: 4,488,547

[45] Date of Patent: Dec. 18, 1984

[54] FACE MASK

[75] Inventor: Beatrice R. Mason, Pittsburgh, Pa.

[73] Assignee: Kenneth R. Bowers, Jr., Bryn Mawr, Pa.

[21] Appl. No.: 415,748

[22] Filed: Sep. 7, 1982

[51] Int. Cl.[3] ..... A62B 7/00

[52] U.S. Cl. ..... 128/202.22; 128/206.19

[58] Field of Search ..... 128/201.25, 206.19, 128/205.27, 205.28, 205.29, 206.17, 202.22; 55/DIG. 33, DIG. 34, DIG. 35, 275, 388, 387, 316

[56] References Cited

U.S. PATENT DOCUMENTS

| | | | |
|---|---|---|---|
| 1,596,060 | 8/1926 | Mase | 55/DIG. 33 |
| 2,249,867 | 7/1941 | Snelling | 55/275 |
| 3,027,865 | 4/1962 | Kautz et al. | 55/DIG. 34 |
| 4,155,358 | 5/1979 | McAllister et al. | 128/202.22 |
| 4,326,514 | 4/1982 | Eian | 55/DIG. 33 |
| 4,365,627 | 12/1982 | Wing | 128/205.27 |

FOREIGN PATENT DOCUMENTS

| | | | |
|---|---|---|---|
| 345672 | 6/1930 | United Kingdom | 128/202.22 |

*Primary Examiner*—Henry J. Recla

*Attorney, Agent, or Firm*—Kenneth R. Bowers, Jr.

[57] ABSTRACT

A disposable surgical mask which changes color to signal significant loss of bacterial filtration efficiency due to moisture accumulation.

4 Claims, 3 Drawing Figures

FACE MASK

BACKGROUND

This invention relates to face masks, especially disposable surgical face masks.

During medical procedures such as surgical operations, it is desired to prevent contamination of the patient's wounds by bacteria present in the exhaled breath of medical personnel and also to prevent inhalation by medical personnel of bacteria present in the environment due to the disease of the patient. Face masks are currently worn to accomplish these two goals.

The face masks now available generally have a single filtration element which prevents or hinders passage therethrough by bacteria. Research indicates that such filtration elements decline in effectiveness with use, primarily due to the absorption of moisture from the air by fibers of the filter. In the latter stages of a lengthy operation, the mask may be counterproductive due to the inability to prevent passage of bacteria gathered and accumulated earlier. Despite the decline in effectiveness with use, it is generally the case that a single mask is used for the duration of an operation with the medical community and the public simply enduring whatever infection results, said infections being seldom traced to mask failure. Subjective evidence suggests considerable patient suffering during recovery from an operation could be prevented by elimination of contamination by medical personnel.

Consequently it is desired to provide an improved face mask.

SUMMARY OF THE INVENTION

A face mask for medical operations which has a layer of anhydrous, hygroscopic material for selective retention of moisture separated from the filtration element. The anhydrous hygroscopic layer functions to increase mask effective life and to signal, by means of a coloration change, the end of effective filtration.

DETAILED DESCRIPTION

The standard face mask of the prior art is a disposable, paper mask which is molded to fit over the user's mouth and nose. It is held in place by a rubber or elastic band which is worn about the head.

Figure 1:
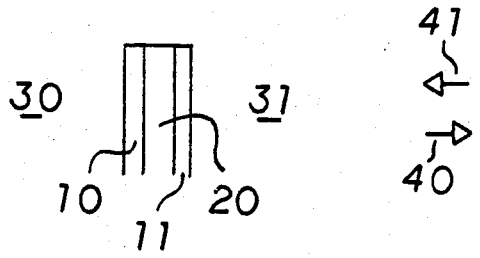
FIG. 1 is a profile schematic of a first embodiment.

The face mask of this invention in a first embodiment may be outwardly similar in mechanical design to the above, but will additionally have layers as shown in FIG. 1 wherein layers 10, 11 are filter elements, probably of paper, while layer 20, shown in FIG. 1 sandwiched between layers 10, 11 is an anhydrous, hygroscopic material, which is herein defined as a material disposed to absorb or adsorb water. These materials are well known to the art of chemistry as hydrates. Some are known to change color upon absorption of water. Table I is a partial list of such substances.

TABLE I

Calcium chloride
Magnesium perchlorate
Phosphorus pentoxide

Activated Alumina
Silica gel

In FIG. 1, region 30 is intended to be the external environment, and region 31 is intended to be facing the mouth and nose of the mask user. Consequently, arrow 41 is the direction of exhaled breath, while arrow 40 indicates inhaled air. Exhaled air 41 passes through layer 11 prior to encounter with the moisture removing action of layer 20, but layer 10 is shielded from undryed exhaled air 41. Inhaled air 40 passes through layer 10 prior to encounter with layer 20, but layer 11 is shielded from undryed inhaled air 40.

The net effect of the configuration of FIG. 1 is a reduced rate of deposition of moisture in layers 10 and 11 thereby increasing the effective life of the mask.

Layer 10 may be sufficiently thin or otherwise may be transparent to the passage of light such that a change in color of layer 20 is visible from environment 30. The mass density of layer 10 may be designed to occasion a color shaft as for example from pink to blue prior to a chosen efficiency decrease in bacterial filtration, perhaps to 90% removal, to signal to the user and others that mask replacement is appropriate.

Variations on the configuration of FIG. 1 can be envisioned, as for example the elimination of layer 10.

Layer 20 is envisioned as being a very thin layer composed of finely powdered anhydrous hygroscopic material mixed with a binder, and sprayed uniformly over the surface of layer 11. Layer 20 may also serve as a glue to secure layers 10 and 11 together.

Figure 2:
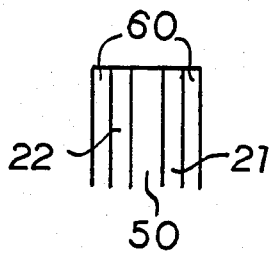
FIG. 2 is a profile schematic of a further embodiment.

A second embodiment is illustrated by FIG. 2 in which layers 21 and 22 are anhydrous, hygroscopic material and layer 50 is the filter element. Layers 60 are optional covers, not necessarily intended for filtration. Depending on the nature of layers 21 and 22, contact with the user's mouth by layers 21 and 22 may be undesirable, requiring a protective layer such as layer 60. The advantage of the second embodiment over the first embodiment of FIG. 1 is that as shown in FIG. 2, the filtration element layer 50 is shielded from moisture as contained in both inhaled and exhaled air, suggesting that this second embodiment is best suited to a mask intended for use throughout an entire operation without replacement. The coloration change feature may or may not be included.

Figure 3:
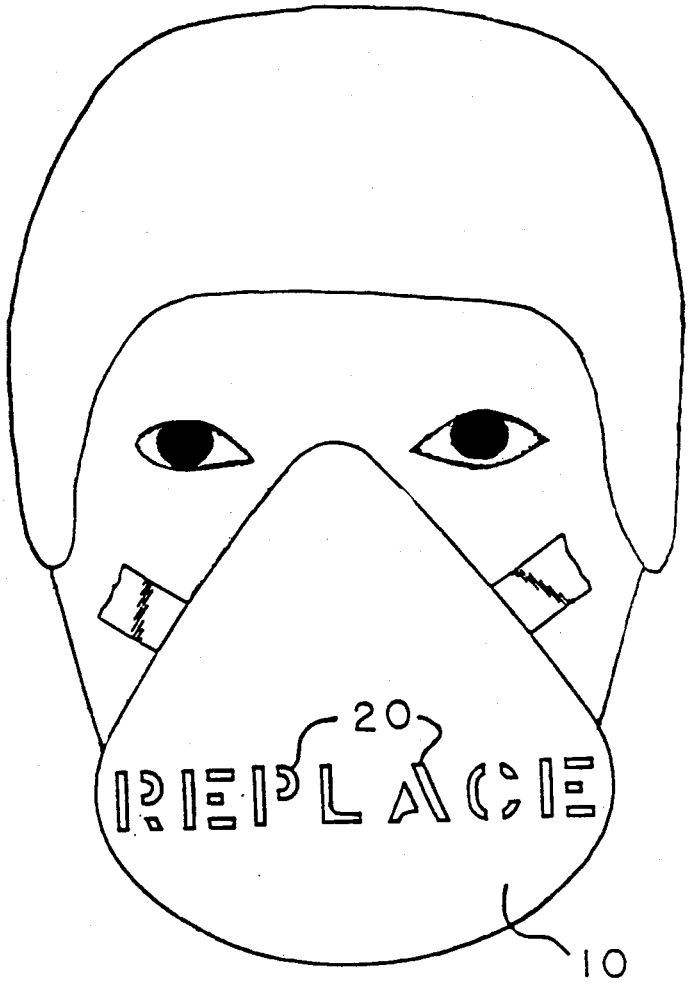
FIG. 3 is a schematic of a preferred embodiment.

In FIG. 3, a face mask is shown having filter element 10 and layer 20 of hygroscopic material. Layer 20 is also shown shaped to convey the message "replace."

The anhydrous hygroscopic layer and filtration layers or cover layers may, prior to use, initially be the same color, with the color change and geometric shape of the anhydrous hygroscopic layer disposed to bring a color contrast into visual discernment conveying a written message, such as the word "replace" or other message of like content.

The material density or quantity of anhydrous hygroscopic material may be varied to match the mask to labeled, intended uses such that for bacterial organisms of low threat, a high percent drop in efficiency occurs before the color change occurs, and for bacteria of high threat, a very low drop is sufficient.

I claim:

1. A surgical face mask having a barrier of permeable material fitted to cover the mouth and nose of the user thereby interdicting respired air and filtering bacteria therefrom, said barrier having means for attachment to the user's face, and said barrier comprising a layer of bacterial filtration material for removal of bacteria from respired air, said filtration material being of a first color, having hygroscopic material partially covering a surface of said layer of filtration material, for the absorption of water from respired air which absorption causes said hygroscopic material to change color to a second color not identical to said first color, said hygroscopic material having a mass content appropriate to cause said color change to occur after a time duration of use of said mask to signal by said color change to the user and to others that use of said mask should be terminated due to accumulation of bacteria.

2. A surgical face mask having a barrier of permeable material fitted to cover the mouth and nose of the user thereby interdicting respired air and filtering bacteria therefrom, said barrier having means for attachment to the user's face, and said barrier comprising a layer of bacterial filtration material for removal of bacteria from respired air, said filtration material being of a first color, having hygroscopic material partially covering a surface of said layer of filtration material, for the absorption of water from respired air which absorption causes said hygroscopic material to change color to a second color not identical to said first color, said hygroscopic material having a mass content appropriate to case said color change to occur after a time duration of use of said mask to signal by said color change to the user and to others that use of said mask should be terminated due to the accumulation of bacteria, wherein said hygroscopic material is shaped to form a written message to the user and to others which message becomes discernable due to said color change.

3. The face of claim 2 wherein said message is the word "replace".

4. The face mask of claim 2 wherein said message is equivalent to the word "replace".

* * * * *